US005172891A

United States Patent [19]

Chen

[11] Patent Number: 5,172,891

[45] Date of Patent: Dec. 22, 1992

[54] SAFE ROAD RAILING

[76] Inventor: Chyi-Bang Chen, No. 209, Tzu Yu Road, Feng Shan City, Kaohsiung Hsien, Taiwan

[21] Appl. No.: 826,436

[22] Filed: Jan. 27, 1992

[51] Int. Cl.[5] ..... A01K 3/00

[52] U.S. Cl. ..... 256/13.1; 256/19; 248/66

[58] Field of Search ..... 256/13.1, 19; 248/66

[56] References Cited

U.S. PATENT DOCUMENTS

| | | | |
|---|---|---|---|
| 1,968,294 | 7/1934 | Heltzel | 256/13.1 |
| 3,207,478 | 9/1965 | Pierre | 256/13.1 |
| 3,377,053 | 4/1968 | Burdett et al. | 256/13.1 |

*Primary Examiner*—Andrew V. Kundrat
*Attorney, Agent, or Firm*—Bacon & Thomas

[57] ABSTRACT

A safe road railing having a horizontal cushion tube provided with a plurality of petaloid elements curving outward to engage a fence plate and absorb shocks received by the plate.

7 Claims, 5 Drawing Sheets

SAFE ROAD RAILING

BACKGROUND OF THE INVENTION

A traditional road railing shown in FIG. 7 comprises a post partly buried in the ground, a wood block and a steel fence plate bolted firmly with the post.

Another conventional road railing shown in FIG. 8 comprises a cylindrical base vertically buried in cylindrical base and an adjusting means inside the protective post, a protective wood block fixed on the upper end of the protective post, and a W-shaped steel plate bolted on the wood block.

One more conventional road railing shown in FIG. 9 comprises an upper post, a lower post, joining means, a plate fastener and a fence plate as its main components. The lower post is positioned in a hollow concrete block buried in the ground, having its upper end firmly combined with the upper end of the lower end of the upper post by means of joining means to facilitate taking off the upper post. A plate base is fixed on the top side of the upper post for combining the fence plate.

The three conventional examples of road railings cannot effectively absorb shocks the fence plate receives, and causes a rebound of the shocking force to give serious damage to a vehicle accidentally colliding with any of the road railings mentioned above. In addition, posts or any components made of wood can gradually wear and tear because of natural elements such as sunshine, rain and wind, resulting in a short service life.

SUMMARY OF THE INVENTION

The safe road railing according to the invention has been devised to have an effective shock absorbing structure for minimizing its rebounding force against a shock it receives, and thus minimize harm and damage to a vehicle and a person/persons therein.

The safe road railing in the present invention comprises a cylindrical base to be buried in the ground, a sustaining tube to be placed in the cylindrical base to stand on the ground, and a horizontal cushion tube having a plurality of curved outward petaloid elements end to contact with a side surface of a fence plate bolted with the cushion tube and the sustaining tube at the same time so that the cushion tube can absorb shocks the fence plate receives.

DETAILED DESCRIPTION OF THE INVENTION

Figure 1:
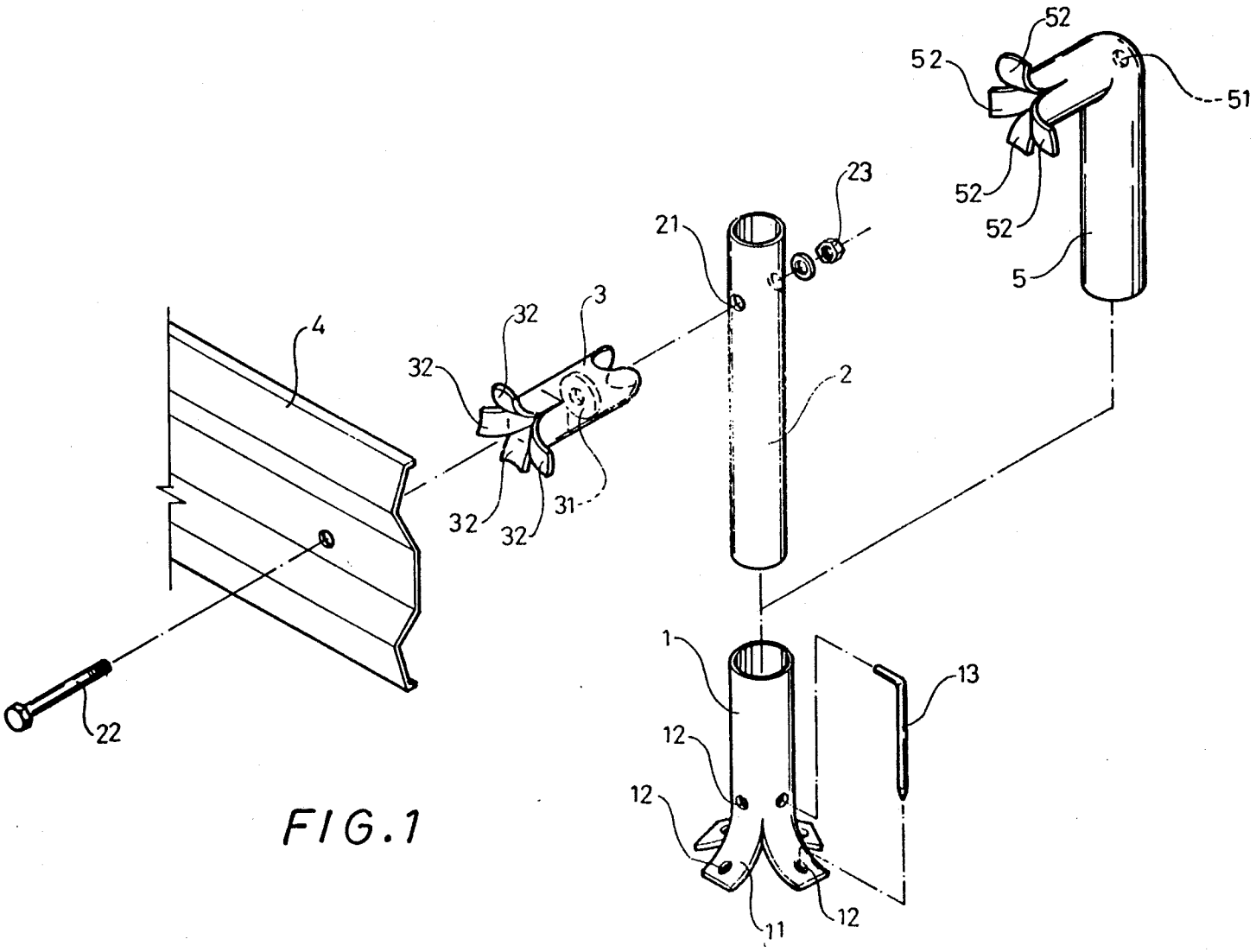
FIG. 1 is an exploded perspective view of the first embodiment of the safe road railing in the present invention.

The first embodiment of the safe road railing according to the invention, as shown in FIG. 1, comprises a cylindrical base 1, a sustaining tube 2, a cushion tube 3, and a fence plate 4 as its main components.

The cylindrical base 1 is to be vertically buried in the ground, having a plurality of feet 11 curving outward and a plurality of nail holes 12 bored a little above the feet for the horizontal portions of bent nails 13 to pass through. Then the vertical portions of the nails 13 extend into the ground so as to keep the base 1 stabilized in standing position to facilitate pouring mortar in the inner cavity of the base 1.

The sustaining tube 2 is to be fitted in the inner cavity of the cylindrical base 1 to stand upright, having two opposite holes 21 for bolts 22 to pass through to screw with nut 23 for combining the cushion tube 3 horizontally with the sustaining tube 2.

The cushion tube 3 has an apertured plate 31 inside its body for a bolt 22 to pass through to combine a fence plate 4 and the cushion tube 3 with the sustaining tube 2, and a plurality of petaloid elements 32 at the outer end. The petaloid elements 32 have some elasticity of bending backward and are kept in touch with a side surface of the fence plate 4, absorbing any shock the fence plate receives.

Figures 2, 3, 4:
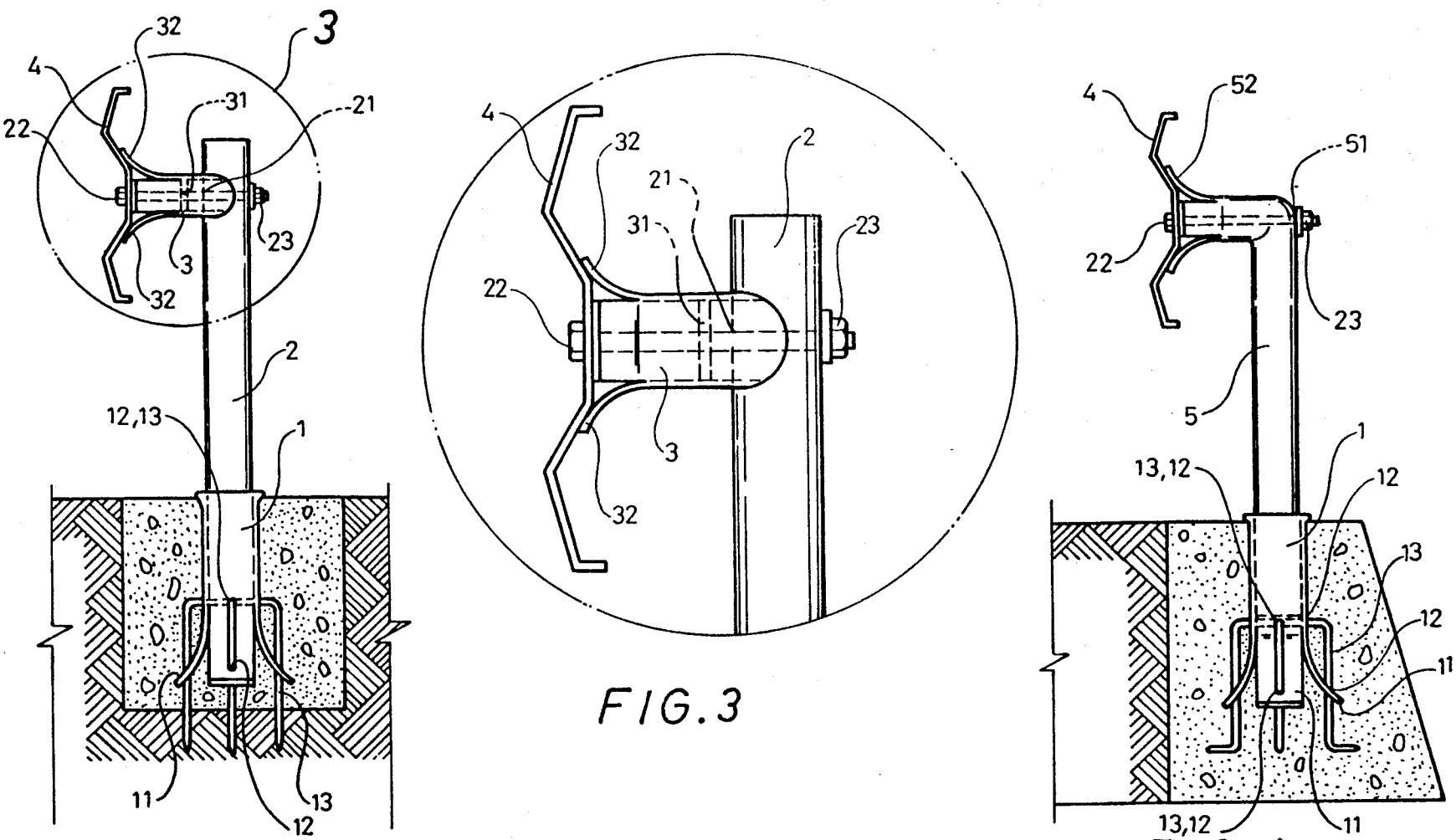
FIG. 2 is a side view of the first embodiment of the safe road railing in the present invention.
FIG. 3 is a magnified view of the part marked 3 in FIG. 2.
FIG. 4 is a side view of the second embodiment of the safe road railing in the present invention.

FIGS. 2 and 3 show this safe road railing combined together, wherein the fence plate 4 is kept stabilized by the elasticity of the curved petaloid elements 32 in the cushion tube 3, and the elasticity of the petaloid elements 32 can absorb shocks the fence plate 4 receives so that the elements 32 do not rebound strongly against a vehicle and persons therein colliding with the railing.

The second embodiment of this invention has an L-shaped sustaining cushion tube 5 formed like the sustaining tube 2 and the cushion tube 3 put together as one unit. The sustaining cushion tube 5 has its vertical portion fitting in the cylindrical tube 1 and its horizontal portion also having a plurality of curved petaloid elements 52 at its end for being adapted to receive the fence plate 4 and a hole 51 for a bolt 22 and a nut 23 to combine the fence plate 4 with the sustaining cushion tube 5. Therefore, the elements 52 can also absorb shocks that the fence plate 4 receives as in the first embodiment.

Figure 5:
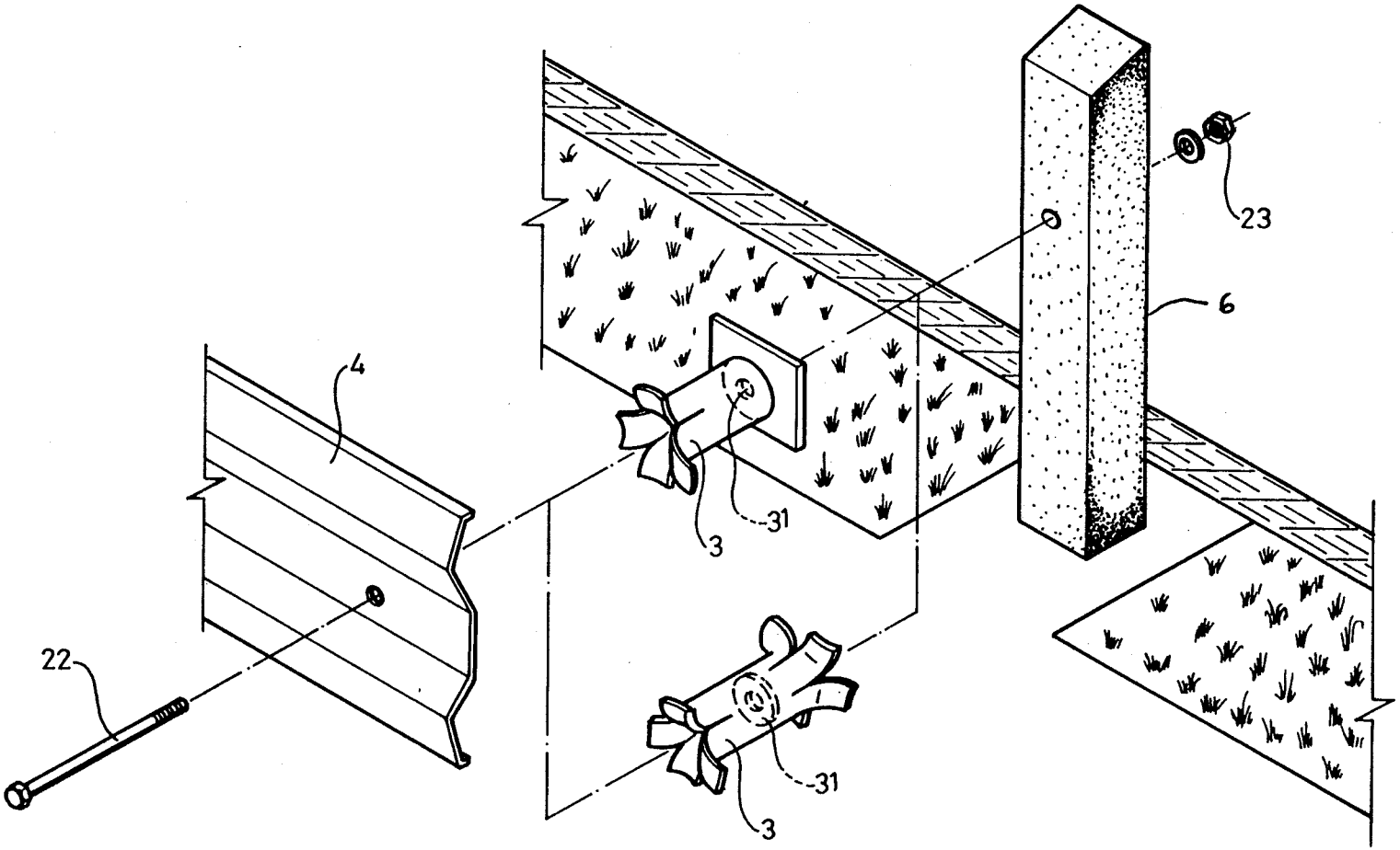
FIG. 5 is a perspective view of the third embodiment of the safe road railing in the present invention.
Figure 6:
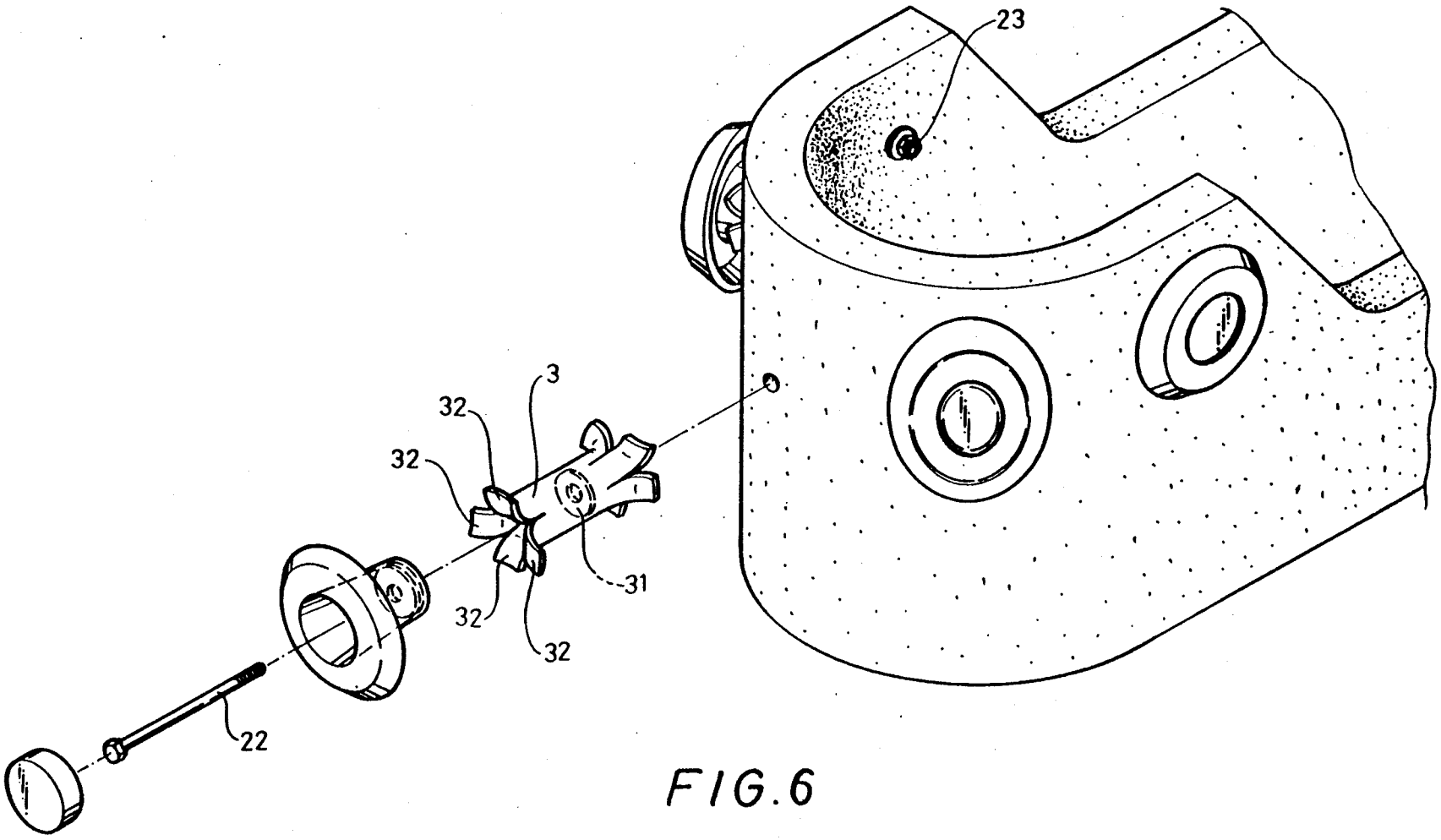
FIG. 6 is a perspective view of the safe road railing utilized in a road separating island.
Figure 9:
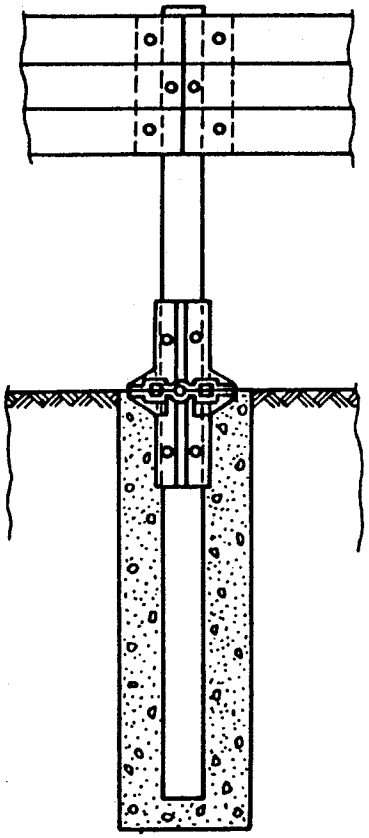
FIG. 9 (PRIOR ART)
FIG. 9 is a front view of one more conventional road railing.
Figure 8:
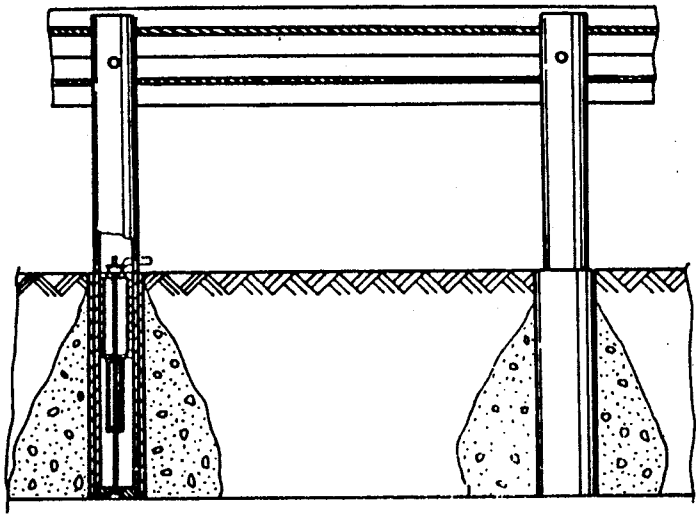
FIG. 8 (PRIOR ART)
FIG. 8 is a front view of another conventional road railing.
Figure 7:
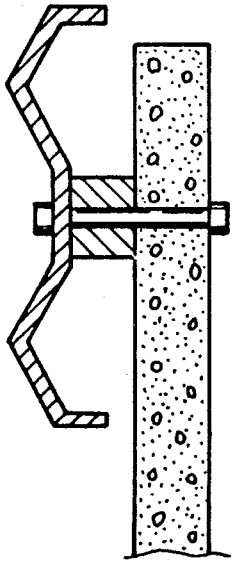
FIG. 7 (PRIOR ART)
FIG. 7 is a side view of a conventional road railing.

The third embodiment of the safe road railing, as shown in FIG. 5, comprises a conventional square concrete stake 6 to take place of the cylindrical base 1 and the sustaining tube 2 in the first embodiment, or the sustaining cushion tube 5 in the second embodiment, and includes a cushion tube 3 additionally provided with a square plate, or a plurality of petaloid elements at both the inner end and the outer end. Then the cushion tube 3 is fixed on the flatside surface of the concrete stake 6, to effectively absorb shocks the fence plate 4 receives.

The cushion tube 3 can be made of stainless steel or the like to prevent corrosion.

What is claimed is:

1. A safe road railing comprising:

a) a support member having a first portion for burying substantially below the ground surface and a second portion for extending vertically substantially above the ground surface;

b) a cushion tube having a first end for attachment to the second portion of the support member to position the tube in a substantially horizontal disposition and a second end configured in a plurality of outwardly curved petaloid elements; and c) a fence plate for bolting to the cushion tube and support member and having a side surface engageable with the petaloid elements, whereby shock forces imparted to the fence plate are absorbed by the cushion tube.

2. The railing of claim 1 wherein:

a) the first portion of the support member includes a cylindrical base having an inner cavity; and b) the second portion of the support member includes a sustaining tube having an end securable within the inner cavity.

3. The railing of claim 2 wherein the cylindrical base includes a bottom configured in a plurality of outwardly curved feet.

4. The railing of claim 2 or claim 3 wherein the cylindrical base includes a plurality of holes for receiving attachment nails therethrough.

5. The railing of claim 2 wherein the sustaining tube and the cushion tube are integrally formed as a single unit.

6. The railing of claim 2 wherein the first end of the cushion tube is configured in a plurality of outwardly curved petaloid elements.

7. The railing of claim 6 wherein the support member includes a concrete stake.

* * * * *